US005343562A

United States Patent [19]

Bible

[11] Patent Number: 5,343,562

[45] Date of Patent: Sep. 6, 1994

[54] RESTRAINING AND PROTECTIVE DEVICE AND METHOD

[76] Inventor: Kenneth G. Bible, 201 Butler Dr., Greenville, S.C. 29611

[21] Appl. No.: 866,973

[22] Filed: Apr. 10, 1992

[51] Int. Cl.[5] ..... A41D 13/08

[52] U.S. Cl. ..... 2/16; 2/66; 2/158; 70/16

[58] Field of Search ..... 2/16, DIG. 6, 158, 66, 2/17, 159, 161.2, 161.4, 910, 917, 160; 70/16; 150/118

[56] References Cited

U.S. PATENT DOCUMENTS

| | | | |
|---|---|---|---|
| 1,300,088 | 4/1919 | Wright | 2/66 |
| 3,203,005 | 8/1965 | Burrows | 2/158 |
| 3,491,373 | 1/1970 | Thomas, Jr. | 2/158 X |
| 4,374,439 | 2/1983 | Norman | 2/161 A |
| 4,642,914 | 2/1987 | Caldeira | 2/DIG. 6 X |
| 4,741,051 | 5/1988 | Bible | 2/158 |

FOREIGN PATENT DOCUMENTS

| | | | |
|---|---|---|---|
| 0239513 | 9/1987 | European Pat. Off. . | |
| 743361 | 5/1943 | Fed. Rep. of Germany | 2/66 |

*Primary Examiner*—Clifford D. Crowder
*Assistant Examiner*—Amy B. Vanatta
*Attorney, Agent, or Firm*—Dority & Manning

[57] ABSTRACT

A restraining and protective device has a pouch A for receiving the handcuffed hands of a person under restraint, and a central transverse strap B attached to one side of the pouch and threaded through an opposite side of the pouch, being tightenable and fastenable for securing and protecting the hands.

9 Claims, 3 Drawing Sheets

RESTRAINING AND PROTECTIVE DEVICE AND METHOD

BACKGROUND OF THE INVENTION

This invention relates to protective devices for aiding in securing the handcuffed hands of a person under restraint which is especially useful for law enforcement personnel as when transporting prisoners.

This invention is an improvement upon the protective mitt for use with handcuffs described in U.S. Pat. No. 4,741,051.

It has been found that protective mitts constructed in accordance with the invention of the above patent are relatively expensive as they are not reuseable and because the ties used in fastening the handcuffs and the hands within the pouch must be cut for release of the hands from the device, and accordingly they, too, are not reuseable. The pouch of the patented device has been constructed of fabric wall panels, and such are not as effective as thicker padded variety of panels used in forming the pouch of the present invention.

Accordingly, it is an important object of this invention to provide an improved restraining and protective device which may be reuseable and which is more comfortable and effectively secures the handcuffed hands of a person in custody or otherwise restrained.

Another important object of the invention is to provide an improved fastening means for securing a protective pouch about the handcuffed hands of a person in custody.

Another important object of the invention is to provide an apparatus and method for effectively securing the handcuffed hands of an individual within a protective covering or pouch which is releasable therefrom without making such release means susceptible for use by the prisoner or person under restraint.

SUMMARY OF THE INVENTION

It has been found that an improved restraining and protective device and method may be provided wherein the handcuffed hands of a person may be placed in a pouch which is open at the top and having opposed sides which are secured and closed for forming the pouch and having a Velcro strap fastened on one end on a central portion on one of the sides and passing between the sides. By providing a slotted guide formed in a central portion of an opposite side, the Velcro strap may be received and secured to a fastener affixed outside a central portion of the opposite side for attachment of the Velcro strap.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
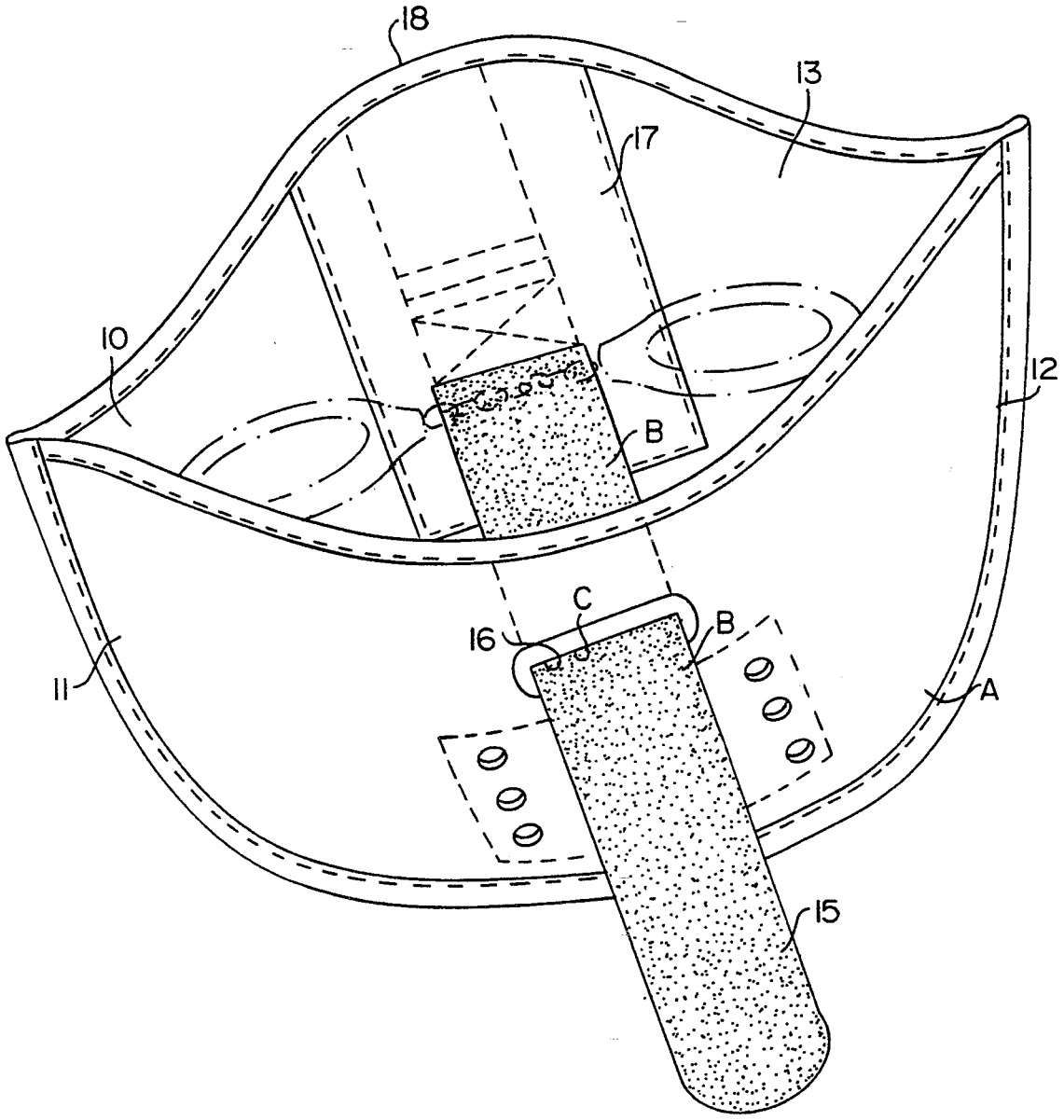
FIG. 1 is a front perspective view illustrating the restraining and protective device being open at the top for reception of the handcuffed hands of a person under restraint.
Figure 2:
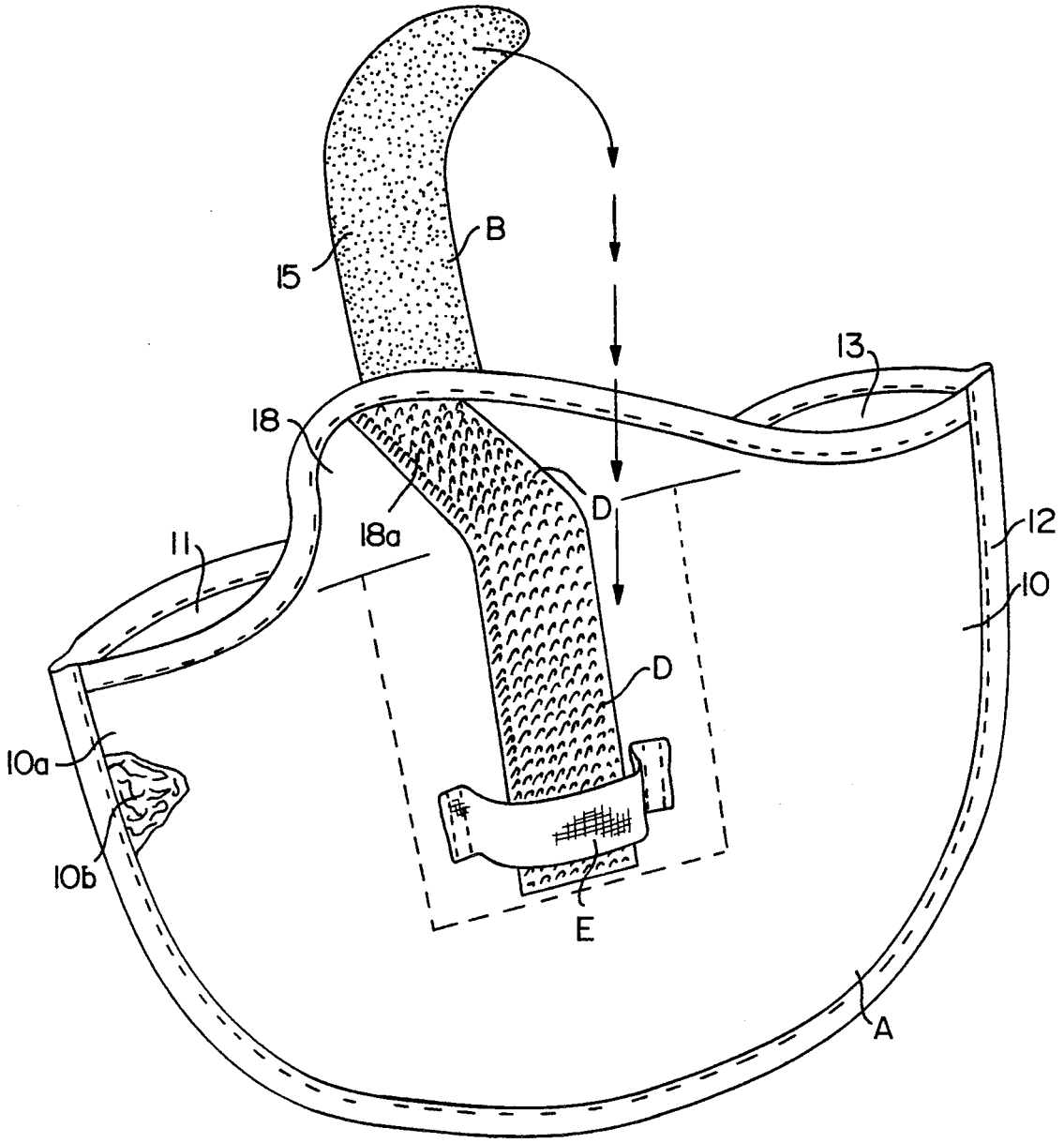
FIG. 2 is a rear perspective view of the restraining and protective device illustrated in FIG. 1 wherein the strap which has been threaded through an opposite slotted guide and tightened is being passed over a top flap for securement to a strap carried by the flap and extending on an outside portion of the opposite side.

The drawings illustrate a restraining and protective device for receiving the handcuffed hands of a person under restraint. A pouch A is open at the top and has opposed sides secured and closed thereabout. A strap B is secured on one end in a central portion of one of the sides and passes therebetween. A slotted guide C is formed in a central portion of an opposite side receiving the strap. A fastener D is affixed to an outside central portion of the opposite side for attachment of the strap thereto. A fastener member E receiving the strap is carried adjacent the Velcro fastener. Thus the strap is tightenable and fastenable for securing and protecting the hands.

A pouch A may be of integral construction but is illustrated as being constructed of opposed respective first and second side panels 10 and 11. Preferably construction of paneled cloth material with the panels 10*a* suitable cushioning material 10*b* is contained in each of the sides. The panel construction is preferable because the sides may be readily secured thereby as by stitching 12 leaving an open top 13. The strap B has a strap portion which may be constructed of textile material as illustrated at 14 for carrying fabric possessing a first plurality of hooks or loops, sold under the trademark VELCRO on an opposite side.

The slotted guide C is preferably in the form of a metallic grommet and the like which has an elongated slot 16 of suitable length to accommodate the width of the strap 15.

The fastener D is preferably as a strip of comparable width as the strap and is secured suitably for reception thereby and securement thereto through being provided at a surface with fabric having a second plurality of hooks or loops, also sold under the trademark VELCRO, which mates with the VELCRO material carried by the strap B. The strap for the fastener D is secured as is the strap 15 with the aid of a reinforcement portion 17 sewed to the inside of the side panel 10.

Figure 3:
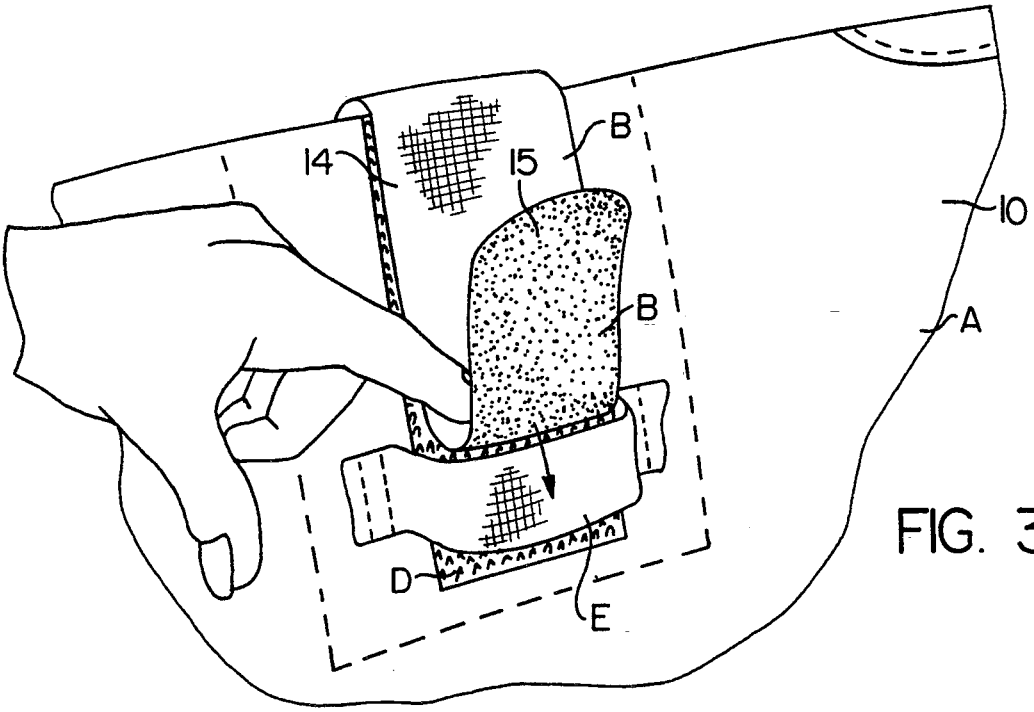
FIG. 3 illustrates the VELCRO side of the strap in engagement with the fastener with the strap being rolled under a longitudinal horizontal loop for securement along the fastener.

A fastener member is provided in the form of a loop constructed preferably of textile material which extends horizontally sufficiently and in proper alignment to receive the strap B as by a rolling action beneath the loop as illustrated in FIG. 3.

Figure 4:
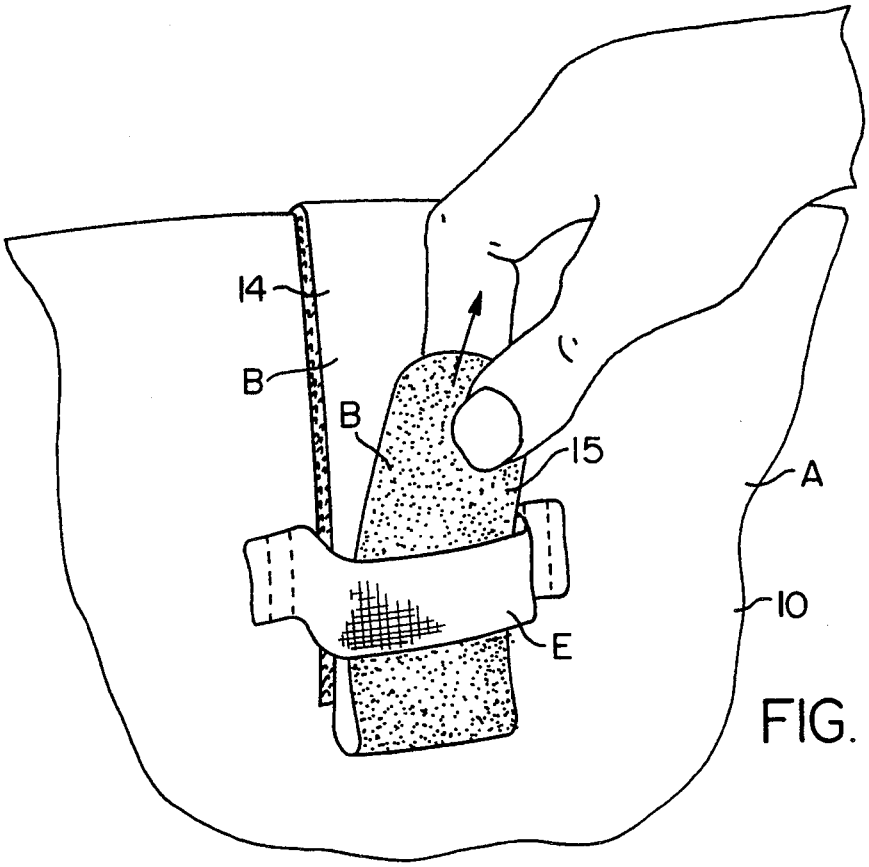
FIG. 4 is a perspective view illustrating an end of the strap being threaded upwardly beneath the loop preparatory to removing and releasing the strap by an upward pulling movement adjacent the end of the strap.

As illustrated in FIG. 4 the strap may be loosened for removal of the device by folding back an end and feeding same upwardly beneath the loop E preparatory to exerting a pulling action for release of the strap and removal of the restraining device.

It will be observed that a flap 18 is provided at the top of the panel 10 and carries thereon a portion 18*a* of the fastener D. The flap is folded downwardly over the panel 11 after tightening of the strap 15 by pulling same through the slotted guide preparatory to folding the strap 15 downwardly by securement as described above beneath the fastening member E.

It is thus seen that the device is easy to use. When handcuffs are used on suspects, they are prevented from using a gun or retrieving most objects with their hands. When the device is used on suspects, it serves to prevent them from grabbing hold of or scratching the officer. The restraining device is used for protecting law enforcement officers when arresting or transporting any person. The person restrained is prevented from getting and using a hidden weapon or the officer's weapon. Furthermore, when transporting prisoners or mentally ill patients, the device serves to prevent them scratching themselves or the transporting officers. The device can be used in the case of mass arrests when it may be impossible to thoroughly search suspects. Since prisoners' hands are rendered virtually useless, there is no way that drugs or evidence can be injected or discarded.

While a preferred embodiment of the invention has been described using specific terms, such description is for illustrative purposes only, and it is to be understood that changes and variations may be made without departing from the spirit or scope of the following claims.

What is claimed is:

1. A restraining and protective device for receiving the handcuffed hands of a person under restraint comprising:

a pouch open at the top and having opposed respective first and second side panels secured and closed thereabout;

a strap provided with a first plurality of attachment hooks or loops, and secured on one end thereof a predetermined distance from said pouch top in a relatively central portion of said first side panel, and said strap having a second end which is free for passing between said side panels;

a slotted guide, formed in a relatively central portion of said second side panel, and situated generally opposite said strap secured one end, for receiving said strap free second end therethrough; and a fastener provided with a second plurality of attachment hooks or loops, complementary to said strap first plurality thereof, and affixed to an outside relatively central portion of said first side panel for selective attachment of said strap to said fastener, wherein said strap free second end, when received in said slotted guide, extends from said relatively central portion of said first side panel, through said corresponding slotted guide and over said pouch top for surrounding a middle connecting portion of a pair of handcuffs, and wherein said strap is tightenable and fastenable for securing and protecting handcuffed hands.

2. The structure set forth in claim 1, further including a fastener member comprising a horizontal loop affixed relatively adjacent said fastener to said outside of said first side panel, for selective engagement with said strap free second end.

3. The structure set forth in claim 1, wherein said slotted guide and said secured one end of said strap are carried in directly opposed relation spaced downwardly from said top of said device a predetermined distance adequate to accommodate within said pouch handcuffs worn on the hands of a person using said device.

4. The structure set forth in claim 3, further including a foldable restraining flap carried at a top of said first side panel carrying said fastener, said flap being situated so as to extend downwardly along the outside of said opposite second side panel.

5. The structure set forth in claim 4, wherein said strap is provided with a first plurality of attachment loops, and said fastener is provided with a second plurality of attachment hooks complementary to said strap attachment loops.

6. The structure set forth in claim 5, wherein said slotted guide comprises a metallic grommet with an elongated slot at least as long as the width of said strap free second end received therethrough, and wherein said first and second side panels are constructed of paneled cloth materials with cushioning materials contained therein and with stitching securing said side panels to one another.

7. A method of restraining and protecting the handcuffed hands of a person under restraint of handcuffs having respective wrist cuff elements and a connecting element therebetween, said method comprising the steps of:

providing a pouch open at the top and having opposed respective first and second side panels secured and closed thereabout; a strap provided with a first plurality of attachment hooks or loops, and secured on one end thereof a predetermined distance from said pouch top in a relatively central portion of said first side panel, and said strap having a second end which is free for passing between said side panels; a slotted guide, formed in a relatively central portion of said second side panel, and situated generally opposite said strap secured one end, for receiving said strap free second end therethrough; and a fastener provided with a second plurality of attachment hooks or loops, complementary to said strap first plurality thereof, and affixed to an outside relatively central portion of said first side panel for selective attachment of said strap to said fastener;

placing the handcuffed hands of a person under restraint into said pouch open top and with said strap passing between said cuff elements, under said connecting element therebetween, and through said slotted guide to the outside central portion of said second side panel; and tightening said strap by drawing said side panels together and folding said strap across and over said pouch top and down the outside of said first side panel so as to attach to said fastener for receiving said strap carried outside said pouch, whereby said strap is tightened and fastened for securing and protecting the hands of the person under restraint.

8. The method set forth in claim 7, further including rolling said strap under a horizontal loop forming a fastener member affixed relatively adjacent said fastener to said outside of said first side panel.

9. The method set forth in claim 8 including passing an end of said strap under said loop for releasing said strap and removing said device.

* * * * *